United States Patent [19]

Winkleblack

[11] 4,257,480

[45] Mar. 24, 1981

[54] HEAT EXCHANGER AND METHOD

[75] Inventor: Robert K. Winkleblack, San Jose, Calif.

[73] Assignee: Electric Power Research Institute, Palo Alto, Calif.

[21] Appl. No.: 937,275

[22] Filed: Aug. 28, 1978

[51] Int. Cl.[3] ..... F28D 7/10

[52] U.S. Cl. ..... 165/165; 176/65

[58] Field of Search ..... 165/141, 165; 122/32, 122/34; 176/65

[56] References Cited

U.S. PATENT DOCUMENTS

| | | | |
|---|---|---|---|
| 2,578,550 | 12/1951 | Holm et al. | 165/141 |
| 2,662,749 | 12/1953 | Buschow | 165/141 |
| 3,247,069 | 4/1966 | Powell et al. | 176/65 X |
| 3,386,497 | 6/1968 | Feldmeier | 165/141 X |
| 4,056,439 | 11/1977 | Robin | 176/65 |

*Primary Examiner*—Samuel Scott
*Assistant Examiner*—Theophil W. Streule, Jr.
*Attorney, Agent, or Firm*—Flehr, Hohbach, Test, Albritton & Herbert

[57] ABSTRACT

A heat exchanger for transferring heat from primary fluid to secondary fluid and particularly one which is especially suitable for cooling a fast breeder nuclear reactor is disclosed herein. The heat exchanger includes a plurality of thermally conductive, concentric shells spaced apart from one another so as to define a number of primary annular spaces and physically isolated secondary annular spaces therebetween. The primary fluid is directed in a continuous flow through the primary annuli, while at the same time the secondary fluid is directed in a continuous flow through the secondary annular spaces.

10 Claims, 9 Drawing Figures

HEAT EXCHANGER AND METHOD

BACKGROUND OF THE INVENTION

The present invention relates generally to heat exchangers and more particularly to a method of transferring heat from primary fluid to secondary fluid utilizing a particularly designed heat exchanger which is especially suitable for transferring heat from primary liquid metal to secondary liquid metal, for example liquid sodium, for cooling a fast breeder nuclear reactor or the like.

A liquid metal cooled fast breeder reactor power plant typically uses what is commonly referred to as an intermediate heat exchanger for transferring heat from liquid metal primary coolant, which becomes radioactive while cooling the reactor core, to an isolated intermediate or secondary circuit of liquid metal which does not become radioactive to any significant extent. In most cases, the heat transferred to the intermediate or secondary stream is not wasted but rather used, for example, to make steam for driving a turbine-generator.

To date, there have been a number of problems associated with power plants of the type just mentioned. For example, the conventional heat exchanger utilized heretofore has typically displayed a relatively high pressure drop, for example 10 psi or more, across its primary liquid metal side. This in turn means that the primary circulation pump must be placed in the "hot leg" of the overall primary circulation loop, that is, the pump must be located in the section of the loop from the reactor to the heat exchanger rather than in the "cold leg" after the heat exchanger. This is mainly due to the net positive suction head requirements of such pumps and specifically because they tend to cavitate if operated at too low a net positive suction head. However, placing the primary circulation pump in the hot leg is undesirable because of being subjected to very severe operating requirements including thermal transients and high temperature, for example temperatures as high as 1050° F. In fact, where pumps of this type are to be used in commercial sized reactors, it may be entirely impractical to design them with a capability to withstand the severe operating requirements under hot leg conditions.

Proposals have been made to place the primary circulation pump in the cold leg of the primary loop by obtaining a net positive suction head sufficient to overcome the pressure drop of the heat exchanger. This has been attempted by pressurizing the cover gas over the primary liquid metal in the reactor vessel, which metal is typically sodium, and also by lengthening the pump shaft, that is, lowering the pump inlet relative to the sodium level in the reactor vessel. However, pressurizing the cover gas is undesirable because it could be hazardous if the pressure were lost during a transient period. Moreover, the longer shaft is undesirable because of bearing problems. Still another proposal has been to reduce the pressure drop by enlarging the overall size of the heat exchanger and specifically by making its ratio of volume to heat transfer surface quite high. However, because space is at a premium with regard to fast breeder reactors, this solution would be quite costly and, in some cases, economically prohibitive.

As will be seen hereinafter, the heat exchanger designed in accordance with the present invention eliminates the various drawbacks just discussed. More specifically, this heat exchanger displays a sufficiently low pressure drop across its primary side so that the primary circulation pump can be located in the cold leg of the primary circulation loop. Moreover, this is accomplished in an uncomplicated and economical way without pressurizing the cover gas over the primary sodium in the reactor vessel, without lengthening the pump shaft and without enlarging the overall exchanger.

OBJECTS AND SUMMARY OF THE INVENTION

One object of the present invention is to provide an uncomplicated and economical heat exchanger for efficiently transferring heat from primary fluid to secondary fluid.

Another object of the present invention is to provide a heat exchanger which is designed to have a relatively low pressure drop across its primary side, that is, the side passing the primary fluid, without the disadvantages discussed above.

Yet another object of the present invention is to provide an uncomplicated and economical as well as compact heat exchanger which is especially suitable for transferring heat from the primary liquid metal coolant of a fast breeder nuclear reactor to secondary liquid metal for cooling the reactor.

Still another object of the present invention is to provide a heat exchanger of the type just recited and particularly one having a sufficiently low pressure drop across its primary side to allow the primary pump to be located in the cold leg of the primary circulation loop after the heat exchanger. Also, this type heat exchanger is particularly well suited to pool type liquid metal cooled fast breeder reactors.

A further object is to provide a method of transferring heat from primary fluid to secondary fluid utilizing the heat exchanger meeting the various other objectives recited above.

As will be discussed in more detail hereinafter, the heat exchanger of the present invention includes a group of thermally conductive, concentric shells which are spaced apart from one another fixed distances for defining concentric annular spaces therebetween. These annular spaces which, for purposes of brevity, may be referred to as annuli include a plurality of primary annuli and a plurality of secondary annuli, the latter being physically isolated from the primary annuli for physically isolating the secondary fluid from the primary fluid. The heat exchanger also includes primary fluid inlet and outlet means for directing the primary fluid from the source of heat, for example from a nuclear reactor, through the primary annuli to the primary pump and back to its source of heat; and secondary fluid inlet and outlet means for directing secondary fluid through the secondary annuli, thereby transferring heat from the primary fluid to the secondary fluid through the intermediate shells.

In a preferred embodiment of the present invention, each primary annulus extends vertically and is open ended, thereby defining an inlet at its top end which is in fluid communication with the primary fluid inlet means and an outlet at its bottom end which is in fluid communication with the primary fluid outlet means. The secondary annuli, which also extend vertically in this preferred embodiment, are alternately disposed between successive primary annuli and are interconnected in fluid communication with one another and with the secondary fluid inlet and outlet means.

These annuli are particularly designed and arranged for efficiently transferring heat from the primary side of the heat exchanger to its secondary side in an economical and uncomplicated manner. Moreover, they are designed to accomplish this while, at the same time, maintaining the pressure drop across the primary side of the heat exchanger at a minimum.

FIG. *7a* is a perspective view of one circumferential segment of a particular circular sealing element extending in a horizontal plane and utilized in the heat exchanger illustrated in FIGS. 1–6.

FIG. *7b* is a perspective view of one circumferential segment of another circular sealing element extending in a vertical plane utilized in the same heat exchanger.

Figure 1:
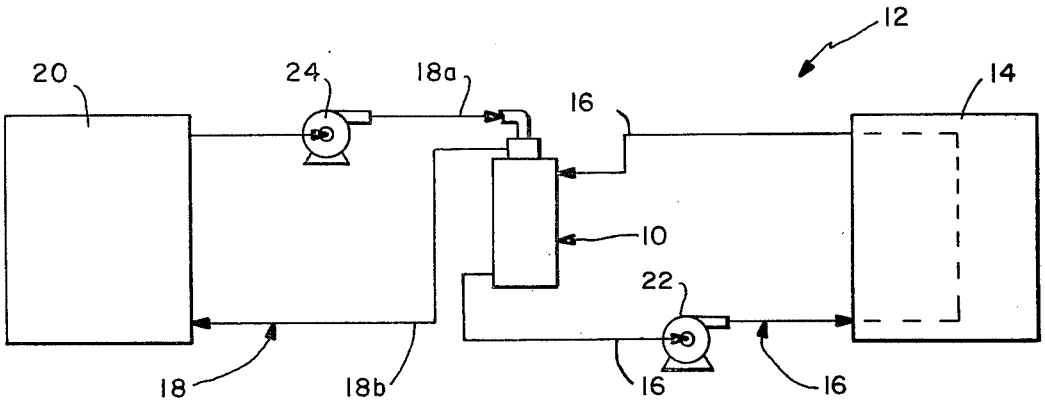
FIG. 1 is a schematic illustration of an overall heat exchanging system including a heat exchanger constructed in accordance with the present invention.
Figure 8:
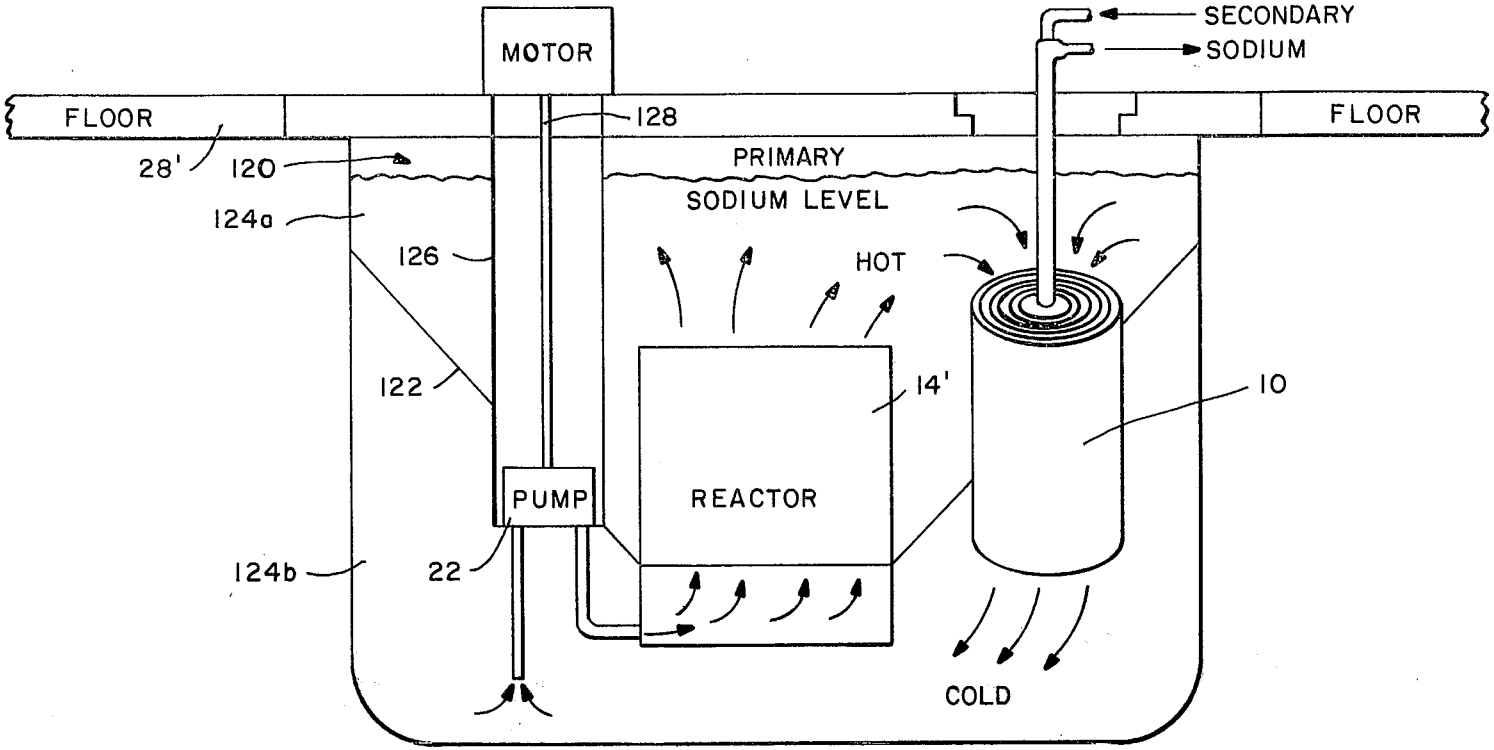

FIG. 8 is a schematic illustration of an overall heat exchanging system of a different type than the system shown in FIG. 1.

DETAILED DESCRIPTION AND PREFERRED EMBODIMENT

Turning now to the drawings, wherein like components are designated by like reference numerals throughout the various figures, a heat exchanger constructed in accordance with the present invention is illustrated and generally designated by the reference numeral 10. As shown in FIG. 1, this heat exchanger comprises part of an overall heat exchanging system 12 including a heat source 14 or actually a heat producing apparatus, a primary fluid conveyance circulation loop 16. The system may also include a heat using apparatus generally indicated at 20.

In the overall system just described, primary fluid circulates through the heat exchanger 10 through cold leg 16*a*, and thereafter through apparatus 14 where it is heated. It thereafter circulates through hot leg 16*b* of the conveyance loop and back into and through the primary side of the heat exchanger. At the same time, secondary fluid is circulated through the secondary side of the heat exchanger, from cold leg 18*a* of a secondary circulation loop 18, where it is heated from the primary fluid and thereafter through secondary leg 18*b* using apparatus 20. The primary fluid is circulated around loop 16 by a circulation pump 22 and the secondary fluid is circulated around loop 18 by a pump 24. In this regard, note that the primary pump is located in the cold leg of its conveyance loop. This is because the pressure across the primary side of the heat exchanger is sufficiently low to allow this.

As stated previously, the heat exchanger 10 in its preferred embodiment is especially suitable for transferring heat from primary liquid metal to secondary liquid metal, specifically liquid sodium, for cooling a fast breeder nuclear reactor or the like. Accordingly, in system 12 illustrated in FIG. 1, heat generating apparatus 14 could be a nuclear reactor generally and a fast breeder nuclear reactor in particular. Obviously, if this is the case, the liquid metal coolant which is pumped through primary conveyance loop 16 would have to pass through the reactor (where it becomes radioactive) in a very specific way which is well known to those of ordinary skill in the nuclear reactor art. The heat, carried out of the nuclear reactor by the radioactive primary liquid metal, is transferred to secondary liquid metal which remains essentially nonradioactive. As illustrated in FIG. 1, the secondary liquid metal, once heated, is carried through heat using apparatus 20 which may be, for example, a steam generator which utilizes the heat in the secondary fluid in making steam for operating a turbine-generator to produce electricity.

Figure 2:
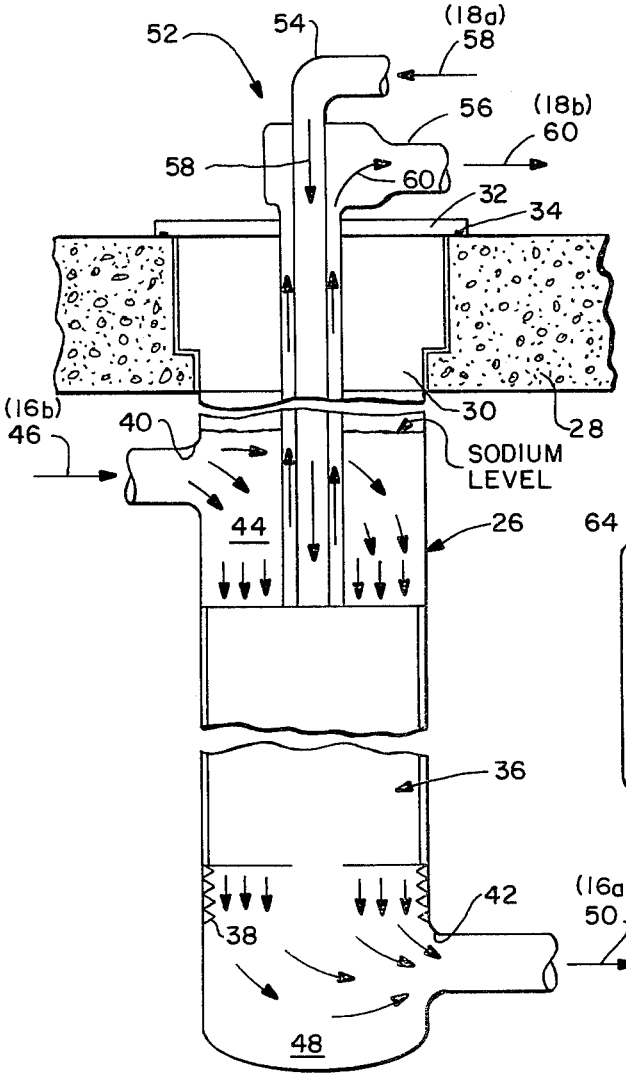
FIG. 2 is a vertical view, partially in section, of the heat exchanger generally illustrated in FIG. 1.

Having described the overall transferring system 12 generally, attention is now directed to a detailed description of heat exchanger 10. While the heat exchanger is especially suitable for use in a system of the type described and particularly one which includes a nuclear reactor, it is to be understood that the principals of the present invention may be used in any heat exchanger provided for transferring heat from a primary fluid to a secondary fluid. As illustrated in FIG. 2, this heat exchanger includes a main cylindrical housing 26 which, in the embodiment shown, is a vertically extending sump tank partially located within and partially extending down from a floor 28 which may also be constructed to serve as a shield for radioactivity. As also illustrated in FIG. 2, the bottom of this tank is intergally closed and its otherwise opened top end is sealed by means of a shield plug 30 in conjunction with a circumferential flange 32 and suitable annular gas seal 34.

Heat exchanger 10 also includes a heat exchanging arrangement 36 located within sump tank 26. As will be seen hereinafter, this arrangement includes a group of vertically extending, thermally conductive, concentric shells held in position within the sump tank. An annular bellows-type spring seal 38 serves as a fluid seal between the outermost periphery of arrangement 36 and the inner wall of tank 26 and also compensates for vertical thermal expansion and contraction of the concentric shells arrangement 36 including the pipe that conducts the secondary (intermediate) sodium up through the shield plug.

Heat exchanger 10 also includes a primary fluid inlet 40 in the form of an inlet nozzle through the wall of sump tank 26 located above arrangement 36 and a primary fluid outlet nozzle 42 through the sump tank wall located below arrangement 36. It should be apparent that inlet 40 and outlet 42 are adapted for fluid communication within the overall primary conveyance loop 16 described with respect to FIG. 1. In this way, primary fluid passes into and fills the top chamber 44 of the sump tank, as indicated by arrows 46. After the primary fluid passes through the exchanging arrangement 36 in the manner to be described, it enters and fills bottom chamber 48 of the sump tank and finally exits through outlet 42, as indicated by arrows 50, where it flows to the pump and eventually passes back into apparatus 14.

In addition to the primary inlet and outlet, heat exchanger 10 includes an assembly 52 for carrying secondary fluid into and through heat exchanging arrangement 36 and back out to the hot leg of the secondary loop. This assembly includes a secondary inlet tube or downcomer 54 and an outer concentric outlet tube 56. As illustrated in FIG. 2, both the downcomer and exit tube extend vertically through flange 32 and shield plug 30. It should be apparent that both the inlet downcomer and outlet tube are adapted for fluid connection in previously recited secondary conveyance loop 18. In this manner, secondary liquid passes into heat exchanging arrangement 36 through downcomer 54, as indicated by arrow 58 and passes out of the heat exchanging arrangement through outlet tube 56, as indicated by arrow 60. The exact way in which this secondary fluid passes through the heat exchanging arrangement and the way in which the downcomer and outlet tubes are interconnected to this latter arrangement will be discussed hereinafter.

Figure 3:
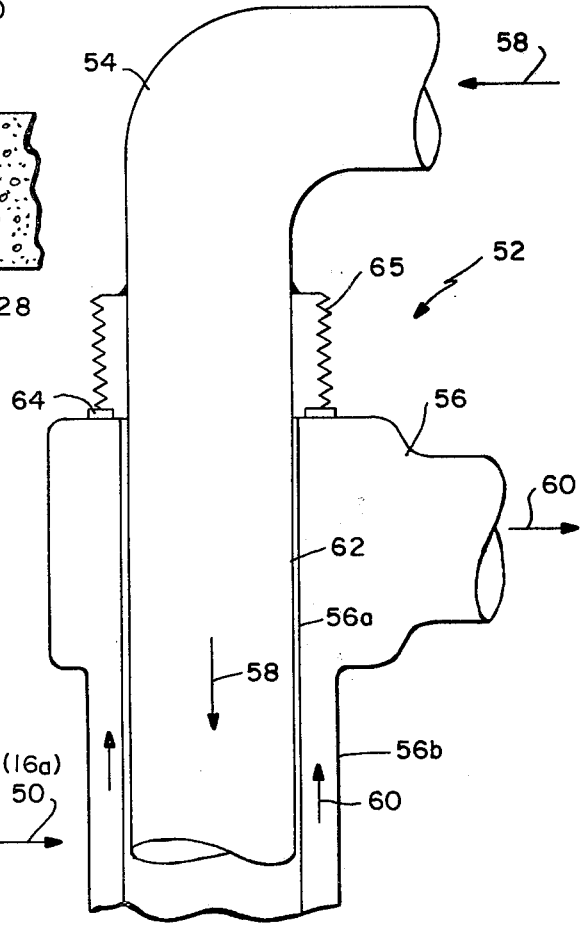
FIG. 3 is an enlarged vertical view, partially in section, illustrating the particular segment of the heat exchanger shown in FIG. 2.
Figure 5:
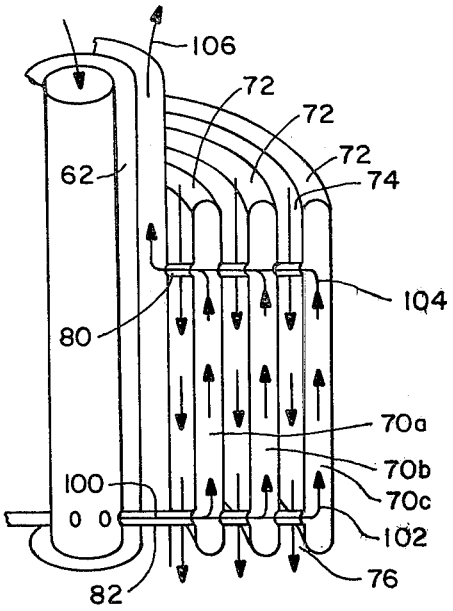
FIG. 5 is a view partially in perspective and partially in vertical section, of the heat exchanger segment illustrated in FIG. 4.

As stated above, outlet tube 56 is positioned concentrically around downcomer 54. As illustrated in FIG. 3, the outlet channel is actually annular in cross-section having an inner wall 56*a* and an outer wall 56*b*. In this way, there are actually two walls between the incoming secondary fluid and the outgoing secondary fluid, specifically the downcomer itself and the innermost wall 56*a* of the outlet tube. In a preferred embodiment of the present invention, these two walls, that is, the downcomer and inner wall 56*a* of outlet tube 56 are spaced apart so as to define an intermediate, vertically extending annular space 62 which is filled with suitable means for thermally insulating the secondary inlet fluid from the secondary outlet fluid so as to minimize the transfer of heat therebetween. The preferred insulating means is argon gas which is sealed within annular space 62 by means of a suitable annular seal 64 and bellows-type spring seal 65, similar to seal 38, located concentrically around and closing the top of annulus 62 as illustrated in FIG. 3. A second seal may be utilized to close the bottom end of annulus 62 if it is otherwise open. However, the outlet tube may extend all the way around the bottom of the downcomer, as seen in FIG. 5 and, in this case, does not utilize a second seal.

Having described sump tank 26 and the way in which both primary fluid and secondary fluid enter and leave the sump tank, attention is now directed specifically to heat exchanging arrangement 36. As stated previously, this arrangement includes a group of vertically extending, thermally conductive, concentric shells constructed of, for example, and generally indicated by the reference numerals 66*a, b, c* and so on in FIG. 4. As seen in this Figure, these concentric shells are spaced apart from one another fixed distances so as to define a plurality of vertically extending, open ended primary annular spaces or annuli 68*a, b,* and *c* and a plurality of vertically extending secondary annular spaces or annuli 70*a, b* and *c* which are best illustrated in FIG. 5. As best seen in this latter figure, the secondary annuli are interposed between primary annuli starting with innermost primary annulas or annular space 68 and ending with an outermost secondary annulus or annular space 70*c*. While only three primary annular spaces and three secondary annular spaces have been shown, it is to be understood that a greater number of each may and most likely will be provided.

It should be noted that both the top ends and the bottom ends of the secondary annuli 70*a, b, c,* etc. are sealed. This may be accomplished by utilizing any suitable sealing means including, for example, the annular seal 72 illustrated in FIG. 7*a*. This seal is constructed of the same material as shells 66, specially in a preferred embodiment, and is U-shaped in cross-section, as illustrated. Moreover, each seal is suitably sized to span between the adjacent shells defining the particular annulas to be sealed and, in a preferred embodiment, is welded to these adjacent shells as best illustrated by the weld lines in FIG. 6. While these seals 72 close the top and bottom ends of secondary annuli 70, the top and bottom ends of primary annuli 68 remain open, as stated previously. As a result, the top ends of these primary annuli define fluid passing inlets generally designated at 74 and the bottom ends of these primary annuli define fluid passing outlets generally designated at 76.

As stated above, both the top and bottom end of each secondary annulus 70 is sealed closed. However, these secondary annuli are interconnected in fluid communication with one another and with both the downcomer 54 and outlet tube 56. More specifically, heat exchanging arrangement 36 includes a plurality of interconnecting members 78 extending across the primary annuli and defining a group of inlet passages 80 and a group of outlet passages 82 which together interconnect the various secondary annuli in fluid communication with one another and with assembly 52 while, at the same time, physically isolating the secondary fluid within the secondary annuli from the primary fluid within the primary annuli. A portion of one interconnecting element is shown in FIG. 7*b* exaggerated in size to illustrate its cross-section. While not shown in this figure, the interconnecting member is annular in its general configuration and, as shown, somewhat U-shaped in cross-section. As seen best in FIG. 6, one continuous edge 78*a* of this member is sized to fit around and be seal-welded against the inner periphery of an opening provided in a particular one of the concentric shells 66, for example shell 66*e*. The other circumferential edge 78*b* of this same interconnecting member would be seal-welded to the inner periphery of a radially aligned opening of the next adjacent shell 66*d*. It should be apparent from FIG. 6 that this particular interconnecting member spans the annular space 68*b* and defines an inlet passage 80 between secondary annulus 70*a* and secondary annulus 70*b*.

Figure 6:
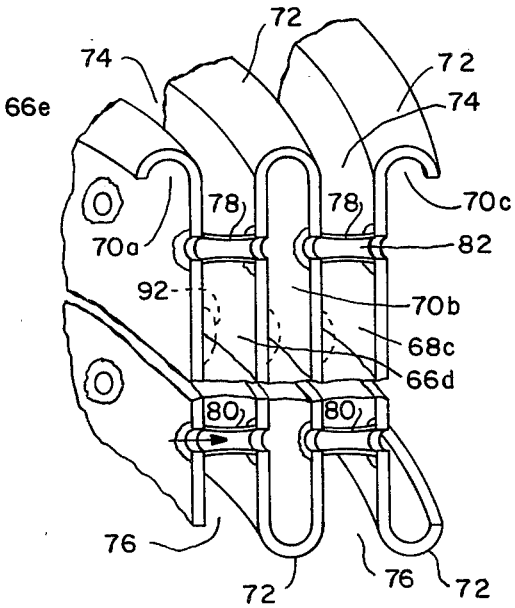
FIG. 6 is an enlarged view, partially in perspective and partially in vertical section, of a part of the heat exchanger segment illustrated in FIG. 5.
Figure 7A:
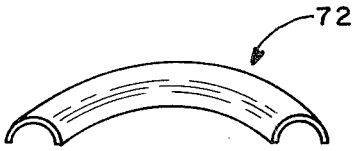
Figure 7B:
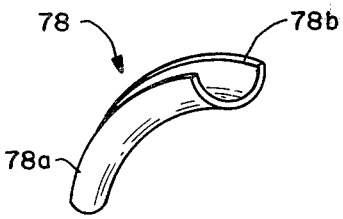

The particular interconnecting member just described is located in close proximity to but spaced apart from the bottom ends of its interconnecting annuli 70*a* and 70*b*, as best illustrated in FIG. 6. In a preferred embodiment of the present invention, there are a plurality of similar interconnecting members between secondary annuli 70*a* and 70*b* and between secondary annuli 70*b* and 70*c* and so on. All of these interconnecting members are equidistant from the bottom ends of the secondary annuli and are circumferentially spaced around the concentric axis of the shells, preferably so that any given interconnecting member extending between a secondary annulus 70*a* and a secondary annulus 70*b* is in radial alignment with a member extending between an annulus 70*b* and annulus 70*c*. Still another group of similar interconnecting members interconnects the bottom end of annulus 70*a* in fluid communication with the bottom of downcomer 54. These interconnecting members are generally aligned with the interconnecting members just described. Secondary annuli 70*a, b, c,* etc. are not only interconnected near their bottom ends as described above but they are also interconnected in the same manner by the same means at their top ends, actually at points in close proximity to but slightly spaced below their top end, as illustrated in both FIGS. 5 and 6. Moreover, innermost secondary annuli 70 is interconnected in fluid communication with outlet tube 56 at these same upper points.

Figure 4:
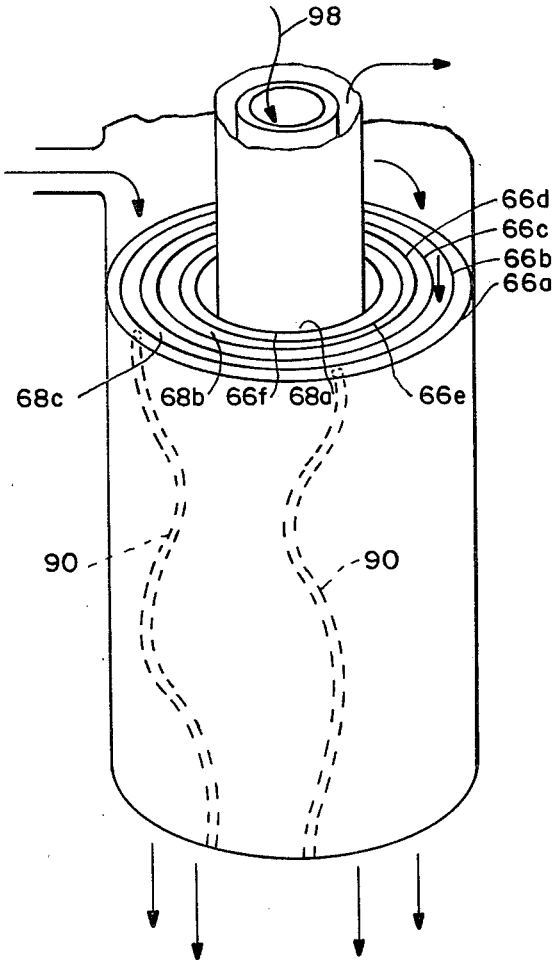
FIG. 4 is a partially broken away perspective view of a segment of the heat exchanger illustrated in FIG. 2.

In a preferred embodiment of the present invention, the various concentric shells 66*a, b, c,* etc. are preferably as thin as possible, for example on the order of 80 mils thick. When used with a nuclear reactor, as described, they are preferrably spaced about between $\frac{1}{4}''$ and $\frac{1}{2}''$ thereby defining annuli of the same width. In order to maintain these shells spaced apart predetermined distances, arrangement 36 includes a plurality of spacers located within the annuli. In a preferred embodiment, these spacers are small tubes generally indicated at 90 in FIG. 4. These tubes have an outside diameter a few mils larger than the width of the annuli and, as illustrated in FIG. 4, they extend somewhat vertically but in a rather spiralled path so as to allow differential expansion of the shells and the overall spacer system. These tubes are welded to one shell for each annulus, near the top and bottom of the shell. The small tubes are thin walled so as to allow a limited amount of compression which accommodates differential radial expansion. The shells are assembled by cooling an inner shell and then warming the next successive outer shell and causing a snug (slight interference) fit which places the spacer tubes in light compression.

While the tubes just described are preferred, it is to be understood that other types of spacers could be utilized. For example, preselected concentric shells could include integrally formed, outwardly projecting dimples 92 generally indicated by dotted lines in FIG. 6. These dimples would be formed in all of the two shells defining each primary annulus and would project out a sufficient distance to define the radial width of each particular annulus.

Having described heat exchanger 10 structurally, attention is now directed to the manner in which it operates to transfer heat from primary fluid to secondary fluid. As stated previously, primary fluid is pumped through primary conveyance loop 16 by means of primary pump 22 and passes through the heat generating apparatus 14 where it is heated and thereafter into upper chamber 44 in sump tank 26 through inlet 40 where it forms a pool as illustrated in FIG. 2. This primary fluid thereafter flows down through primary annuli 68 from open inlet ends 74 and into bottom chamber 48 through open outlet ends 76 where it passes out into cold leg 16*a* of the conveyance loop through outlet 42. It is worthy to note at this point that the only obstructions to flow of the primary fluid as it passes through the primary annuli, other than friction, are the spacers 90 (or 92). As a result, the pressure drop across these annuli is relatively low, for example on the order of 7 to 9 psi lower than conventional heat exchangers used in loop type fast reactor plants of the same capacity.

At the same time, secondary fluid is circulated through the cold leg 18*a* of secondary conveyance loop 18 and into downcomer 54 by means of pump 24. As best illustrated in FIGS. 4 and 5, this secondary fluid passes through the downcomer, as indicated by the arrows 98, and into the bottom ends of the secondary annuli, as indicated by the arrows 100. The fluid then passes up the secondary annuli (arrows 102) and out the radial passages into outlet tube 56 (arrows 104) where it passes up the tube (arrows 106) and finally into the hot leg 18*b* of the secondary conveyance loop. It should be apparent that as the secondary fluid circulates through the secondary annuli, it takes heat from the primary fluid through the shells therebetween. At the same time, however, as the secondary fluid passes through the various secondary annuli, there is a semistagnant fluid at the bottom ends of the secondary annuli below the bottom interconnecting members 80 and at the top end of the annuli above the top interconnecting members. This semistagnant stratification of fluid above and below the interconnecting radial passages serves to lessen the thermal stresses and mitigate thermal transient effects caused by extreme changes in temperature of incoming secondary fluid. Moreover, it is worthy to note that as the secondary fluid passes out of the secondary annuli and up outlet tube 56, it is theremally insulated from the incoming secondary fluid by insulation barrier 62 which, as stated previously, is preferrably argon gas. In this way, little if any of the heat captured by and carried away with the secondary fluid as it exits the secondary annuli is lost to the incoming secondary fluid and, hence, provides a more sufficient exchange.

Heat exchanger 10 has been described thus far in conjunction with a loop type liquid metal cooled breeder reactor plant generally illustrated in FIG. 1. However, it is to be understood that the heat exchanger can also be utilized in a pool type liquid metal cooled breeder reactor plant, as illustrated schematically in FIG. 8.

As seen in FIG. 8, heat generating apparatus 14' (a fast breeder nuclear reactor) is located below a floor 28' (similar to floor 28) and within an overall cavity generally designated at 120. This cavity includes suitable partition means indicated generally at 122 for defining two separate pools of primary sodium, a hot pool 124*a* and a cold pool 124*b*. As also seen in FIG. 8, previously recited primary pump 22 and heat exchanger 10 are located in cavity 120. The pump is shielded from both pools by suitable shielding means 126 and driven by a motor 128 through drive shaft 128. The heat exchanger is located across the two pools in the manner shown such that sodium from the hot pool is adapted to pass through the primary annuli to the cold pool.

The sump tank of the loop type plant system (illustrated in FIG. 2) is not needed for the heat exchanger application in the pool type plant. Hot primary sodium flow is in the open pool (rather than via a pipe) from the reactor to the top of the concentric shells arrangement 36. The primary flow from the bottom of the shell arrangement 36 is directly into the lower part of the pool. The primary sodium pump 22 in this system takes suction directly from this lower part of the pool and this causes a slightly lower pressure in the lower part creating the small pressure drop needed to flow primary sodium through the heat exchanger.

What is claimed is:

1. A heat exchanger for transferring heat from primary fluid to secondary fluid, comprising:

(a) support means for supporting a group of vertically extending, thermally conductive concentric shells spaced-apart from one another fixed distances for defining therebetween (i) a plurality of vertically extending open ended primary annuli, the top ends of which define inlets into the annuli and the bottom ends of which define outlets out of the annuli, and (ii) a plurality of vertically extending secondary annuli respectively disposed between said primary annuli;

(b) means for sealing closed the top and bottom ends of said secondary annuli for physically isolating said secondary annuli from said primary annuli;

(c) primary fluid inlet means cooperating with said support means and adapted to receive a supply of primary fluid heated by a given source of heat and in fluid communication with the top opened inlets of said primary annuli for directing said heated primary fluid into the latter;

(d) primary liquid outlet means cooperating with said support means and in fluid communication with the bottom opened outlets of said primary annuli for directing said primary fluid from said primary annuli back to said source of heat;

(e) a secondary fluid inlet disposed within the innermost one of said concentric shells for receiving said secondary fluid from an external location;

(f) a secondary fluid outlet disposed adjacent to the secondary fluid inlet for delivering said secondary fluid back to said external location;

(g) means for defining a first group of radially extending inlet passageways between said secondary fluid inlet and said secondary annuli, adjacent one end of the latter and through but isolated from said primary annuli, said first group of passageways serving to pass said secondary fluid from said secondary inlet into said secondary annuli; and (h) means for defining a second group of radially extending outlet passageways between said secondary annuli and said secondary fluid outlet, adjacent an opposite end of the secondary annuli and through but isolated from said primary annuli, said second group of passageways serving to pass said secondary fluid from said secondary annuli into said secondary outlet.

2. A heat exchanger according to claim 1 wherein said first inlet passageways are horizontally aligned with one another and equally circumferentially spaced around the concentric axis of said annuli and wherein said second passageways are horizontally aligned with one another and equally circumferentially spaced around said axis.

3. A heat exchanger according to claim 2 wherein said inlet passageways and said outlet passageways are respectively located in close proximity to but spaced from the closed ends of said secondary annuli.

4. A heat exchanger according to claim 1 wherein said secondary vertical fluid inlet and said secondary fluid outlet respectively include concentric inlet and outlet tubes and a concentric annulus including thermal insulation therebetween.

5. A heat exchanger according to claim 1 wherein said heat exchanging arrangement includes spacer means located within said annuli for maintaining said concentric shells spaced from one another, said spacer means including at least one thermally compressible tube located in each of said annuli, said tubes extending in curved paths between the opposite ends of said annuli and having sufficiently thin walls so as to display a limited degree of cross-sectional resiliency in order to compensate for thermal expansion and contraction of said shells.

6. A heat exchanger according to claim 5 wherein said compressible tubes and said means defining said passageways are the only obstructions to passage of said primary fluid through said primary annuli, whereby to maintain the pressure drop therethrough relatively low.

7. A heat exchanger according to claim 1 wherein said primary fluid outlet means includes pump means for drawing said fluid away from said primary annuli.

8. A heat exchanger according to claim 1 wherein each of said passageways is defined by an annular member which is U-shaped in radial section.

9. A heat exchanger according to claim 1 wherein said secondary annuli end closing means include an annular member for closing each end of each of the secondary annuli, each of said last-mentioned members being U-shaped in radial cross-section.

10. A heat exchanger especially suitable for transferring heat from primary liquid metal to secondary liquid metal for cooling a fast breeder nuclear reactor or the like, said heat exchanger comprising:

(a) support means for supporting a group of vertically extending, thermally conductive, concentric shells spaced apart from one another fixed distances for defining therebetween (i) a first plurality of vertically extending open ended primary annuli, the top ends of which define inlets into the annuli and the bottom ends of which define outlets out of the annuli, and (ii) a second plurality of vertically extending secondary annuli respectively disposed between said primary annuli;

(b) a plurality of annular members for sealing closed the top and bottom ends of said secondary annuli for physically isolating the latter from said primary annuli, each of said members being substantially U-shaped in radial section;

(c) spacer means located within said annuli for maintaining said concentric shells spaced from one another, said spacer means including at least one thermally compressible tube located in each of said annuli, said tubes extending in curved paths between the opposite ends of said annuli and having sufficiently thin walls so as to display a limited degree of cross-sectional resiliency in order to compensate for thermal expansion and contraction of said shells;

(d) primary fluid inlet means adapted for connection with said nuclear reactor and in fluid communication with the top opened inlets of said primary annuli for directing said primary liquid metal from said reactor into said primary annuli;

(e) primary liquid outlet means adapted for connection with said reactor and in fluid communication with the bottom opened outlets of said primary annuli for directing said primary liquid metal from said primary annuli back to said reactor;

(f) a secondary fluid inlet in the form of a tube disposed concentrically within the innermost one of said concentric shells for receiving said secondary fluid from an external location;

(g) a secondary fluid outlet in the form of a tube located concentrically around the secondary inlet tube within the innermost one of said concentric shells for delivering said secondary fluid back to said external location;

(h) thermal insulation located between said secondary inlet tube and said secondary outlet tube;

(i) means for defining a first group of radially extending inlet passageways between said secondary fluid inlet tube and said secondary annuli and isolated from said primary annuli, said secondary inlet passageways being positioned equidistant from one end of said secondary annuli, equally circumferentially spaced around the concentric axis of said shells and serving to pass said secondary fluid from said secondary inlet into said secondary annuli, each of said passageways being defined by an annular member which is substantially U-shaped in radial section, and (j) means for defining a second group of radially extending outlet passageways between said secondary annuli and said secondary fluid outlet and isolated from said primary annuli, said outlet passageways being positioned equidistant from an opposite end of said secondary annuli, equally circumferentially spaced around said concentric axis, serving to pass said secondary fluid from said secondary annuli into said secondary outlet, each of said passageways being defined by an annular member which is substantially U-shaped in radial section.

* * * * *